US005125336A

United States Patent [19]

Germann

[11] Patent Number: 5,125,336

[45] Date of Patent: Jun. 30, 1992

[54] DEVICE FOR TRANSFERRING INDIVIDUAL SHEETS TO THE IMPRESSION CYLINDER OF A SHEET-FED ROTARY PRINTING MACHINE

[75] Inventor: Albrecht J. Germann, Wuerzburg, Fed. Rep. of Germany

[73] Assignee: De La Rue Giori S.A., Lausanne, Switzerland

[21] Appl. No.: 719,821

[22] Filed: Jun. 24, 1991

[30] Foreign Application Priority Data

Jul. 20, 1990 [CH] Switzerland ..... 2411/90

[51] Int. Cl.[5] ..... B41F 11/00

[52] U.S. Cl. ..... 101/137; 101/217; 101/410; 271/206; 271/245

[58] Field of Search ..... 101/137, 142, 145, 154, 101/177, 409, 410, 217, 218; 271/206, 226, 245, 109

[56] References Cited

U.S. PATENT DOCUMENTS

| | | | |
|---|---|---|---|
| 1,514,049 | 11/1924 | Ichida | 101/137 |
| 1,591,127 | 7/1926 | Harrold et al. | 101/137 |
| 2,427,904 | 9/1947 | Davidson | 101/217 |
| 3,002,450 | 10/1961 | Papa et al. | 101/137 |
| 3,785,287 | 1/1974 | Dahlgren | 101/137 |
| 3,865,362 | 2/1978 | Luffy et al. | 101/410 |
| 4,210,079 | 7/1980 | Raes | 101/410 |
| 4,466,350 | 8/1984 | Schilling | 101/410 |
| 4,667,952 | 4/1987 | Jeschue et al. | 101/410 |
| 4,691,631 | 9/1987 | Ishii et al. | 101/177 |
| 4,697,512 | 10/1987 | Simeth | 101/410 |

FOREIGN PATENT DOCUMENTS

| | | | |
|---|---|---|---|
| 576960 | 2/1924 | France | 101/137 |
| 0148058 | 7/1986 | Japan | 101/410 |

*Primary Examiner*—Eugene H. Eickholt

*Attorney, Agent, or Firm*—Kane, Dalsimer, Sullivan, Kurucz, Levy, Eisele and Richard

[57] ABSTRACT

The device has a transfer cylinder (2) with a drum (4) which is adjustable in the circumferential direction relative to its shaft (3) and which carries sheet grippers (8) with a front stop (8*a*) for the sheets (B). The diameter of the transfer drum (2) is equal to 1/N of the diameter of the plate cylinder which carries N printing plates. The shaft (3) of the transfer cylinder (2) rotates at a constant speed and executes N revolutions when the plate cylinder is executing one revolution. By means of a controllable setting device, the drum (4) is so displaced relative to the shaft (3) during each revolution that the front stop (8*a*), when its transfer position in which a sheet is transferred to the impression cylinder (D) is passed, assumes a position by which the exact register of this sheet in relation to the position of the printing plate printing it on the plate cylinder is set. This guarantees that the width of the front margin between the sheet front edge and print start is of the same size on all the printed sheets, without the need to adjust the printing plates exactly on the plate cylinder in a time-consuming way.

8 Claims, 7 Drawing Sheets

DEVICE FOR TRANSFERRING INDIVIDUAL SHEETS TO THE IMPRESSION CYLINDER OF A SHEET-FED ROTARY PRINTING MACHINE

FIELD OF THE INVENTION

The invention relates to a device for transferring individual sheets to the impression cylinder of a sheet-fed rotary machine, according to the pre-characterizing clause in claim 1.

PRIOR ART

Sheet-transfer devices of this type in rotary printing machines often consist of a stop drum and of a transfer drum which interacts with the latter and which transports the sheets onto the impression cylinder at regular intervals. These intervals correspond, of course, to the positions of the printing plates fastened uniformly to the plate cylinder of the printing machine.

A device of the type described in the pre-characterizing clause of claim 1 is known from German Patent Specification 2,330,484. This device works with a suction-conveyor roller which is drivable at a non-uniform speed in such a way that a sheet conveyed by it is transported up against the front stops of the impression cylinder at a somewhat excessive speed.

A feature common to the sheet-transfer devices known hitherto is that they administer the oncoming sheets to the impression cylinder at exactly the same rate, and the transfer point of the transfer cylinder at which the sheet front edge is taken over by the grippers of the impression cylinder is always the same. In order to ensure, during the printing of the sheets, that the spacing between the sheet front edge and the print start, that is to say the free sheet front margin, is always the same size, it is necessary, when the printing plates are being fastened to the plate cylinder, to make sure with care that the printing plates are mounted on the circumference of the plate cylinder with exact uniformity, that is to say at exactly the same spacing. This means, therefore, that, on a plate cylinder with two, with three or with four printing plates, these must have an exact angular spacing of 180°, of 120° or of 90° respectively. The result of even only very slight deviations of this geometry is that the printed sheets have front margins of differing width. This is a disadvantage, above all in security printing, especially in bank note printing, in which the sheets have a number of security prints arranged in rows and columns and are subsequently cut into individual securities. Different widths of the sheet front margins, the front edges of which serve as a reference edge for cutting, therefore result in a faulty centering of the securities and consequently rejects.

However, adjusting the printing plates exactly when they are being fastened on the plate cylinder, as has been necessary hitherto to prevent these errors, is very laborious and time-consuming.

In intaglio printing machines, such as are used especially for the printing of bank notes, after printing has gone on for some time there often occurs, because of the high pressure of the impression cylinder against the plate cylinder, an elongation of the printing plates, the effects of which can in some cases be compensated by a new adjustment of the printing plates on the plate cylinder. This new adjustment of the printing plates is likewise a time-consuming affair.

SUMMARY OF THE INVENTION

The object on which this invention is based is to provide a sheet-transfer device which allows an automatic adaptation of the sheet transfer in such a way that the sheets reach the printing plates printing them always in an exactly aligned position, that is to say completely in register, so that there is no need to have to adjust the printing plates themselves at exactly identical angular spacings when they are being mounted on the plate cylinder.

According to the invention, this object is achieved by means of the features indicated in the characterizing clause of claim 1.

Thus, the printing plates, when being fastened onto the plate cylinder, need not be adjusted in exact positions accurate to a fraction of a millimeter, but it is sufficient to adjust the setting device for the front stop of the transfer cylinder according to the positions of the printing plates on the plate cylinder before the start of printing. This can be carried out either by hand on the basis of some test prints or automatically by means of servomotors which are controlled by readers as a function of read-off register marks printed on the sheets. Likewise, elongations of the printing plates can be approximately compensated, without readjusting these, by regulating the setting device.

Expedient embodiments of the device according to the invention emerge from the dependent claims.

BRIEF DESCRIPTION OF THE DRAWINGS

The invention is explained in more detail by means of an exemplary embodiment with reference to the drawings. In these.

DESCRIPTION OF THE PREFERRED EMBODIMENT

Figure 4:
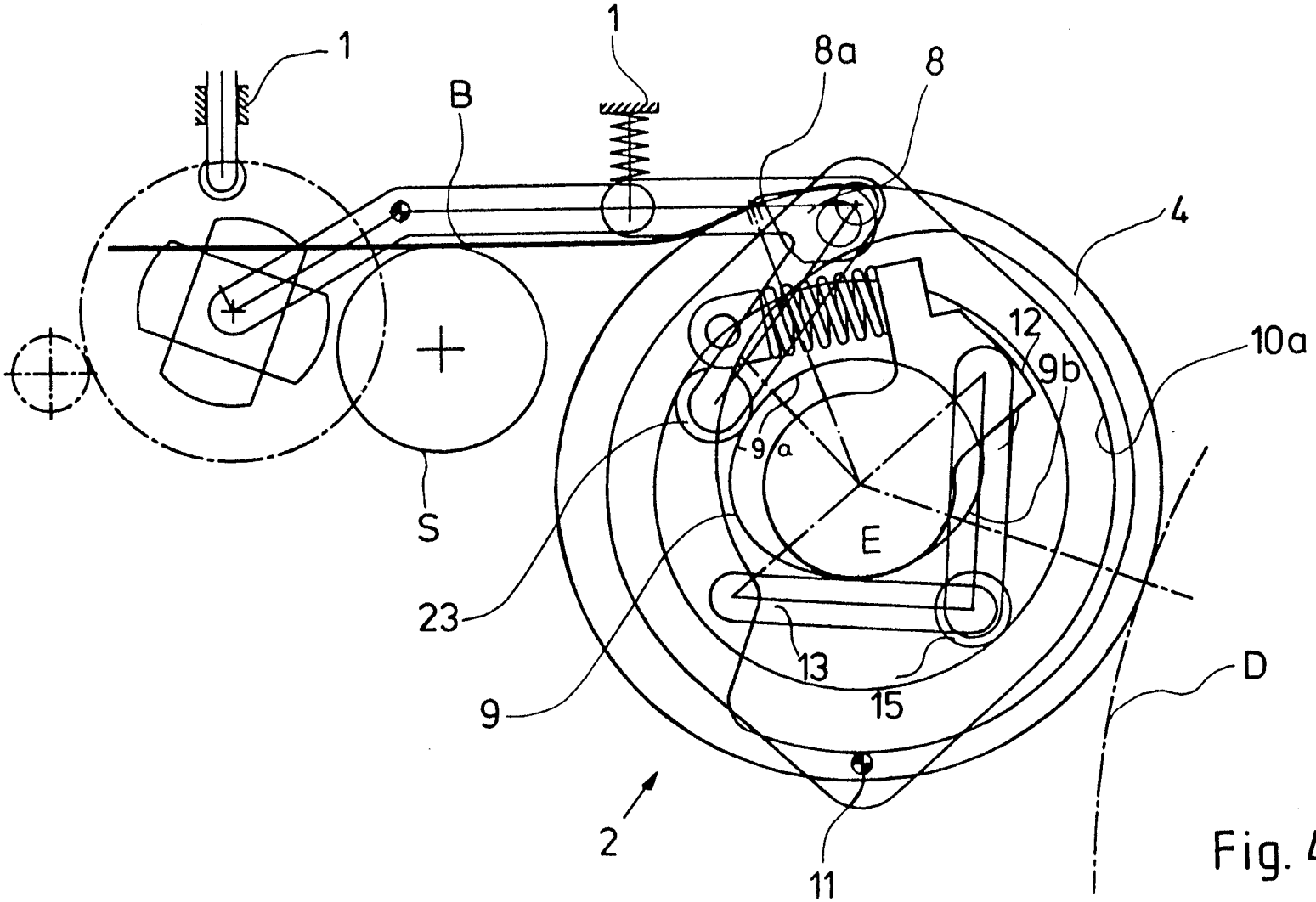
Figure 5:
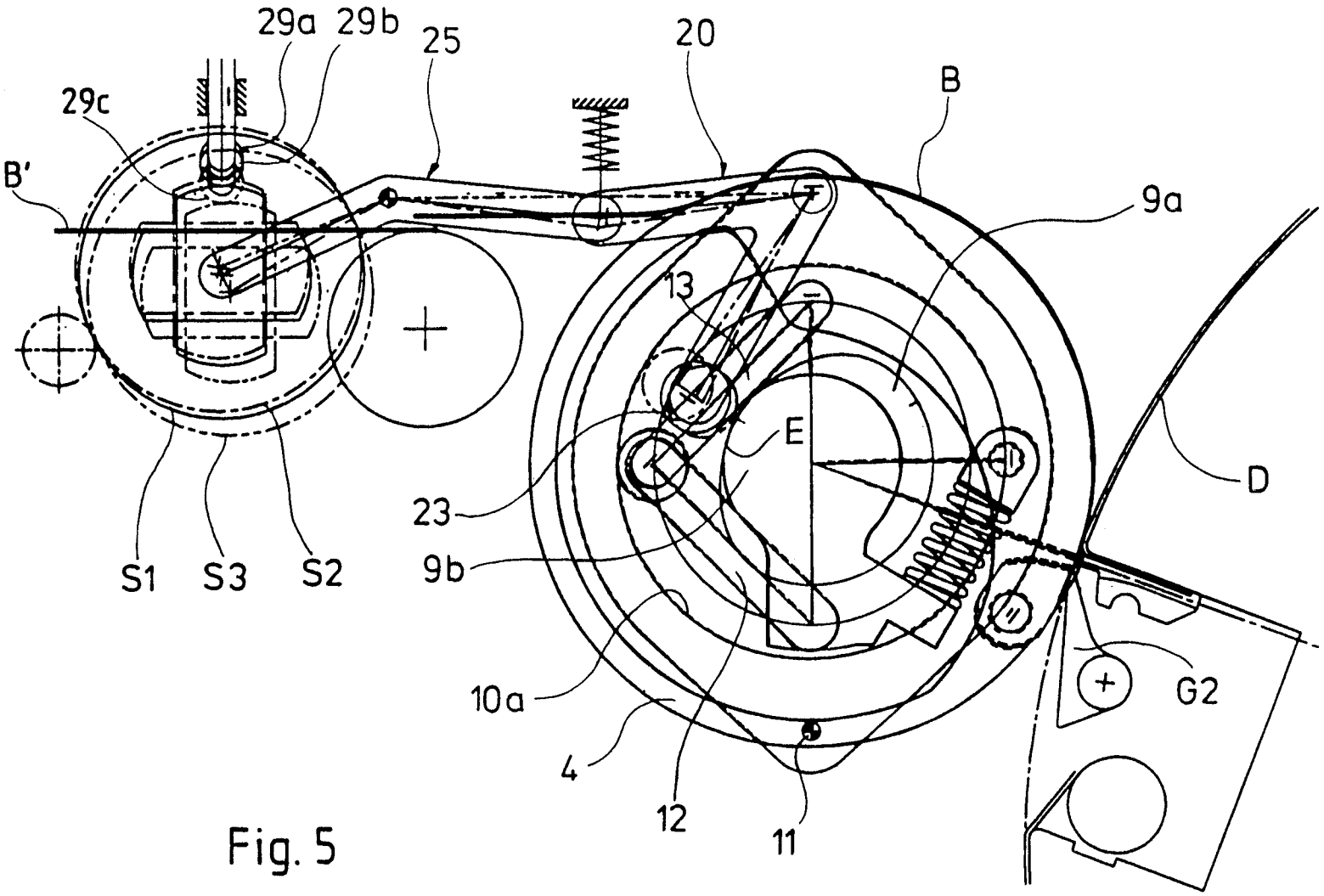
Figure 6:
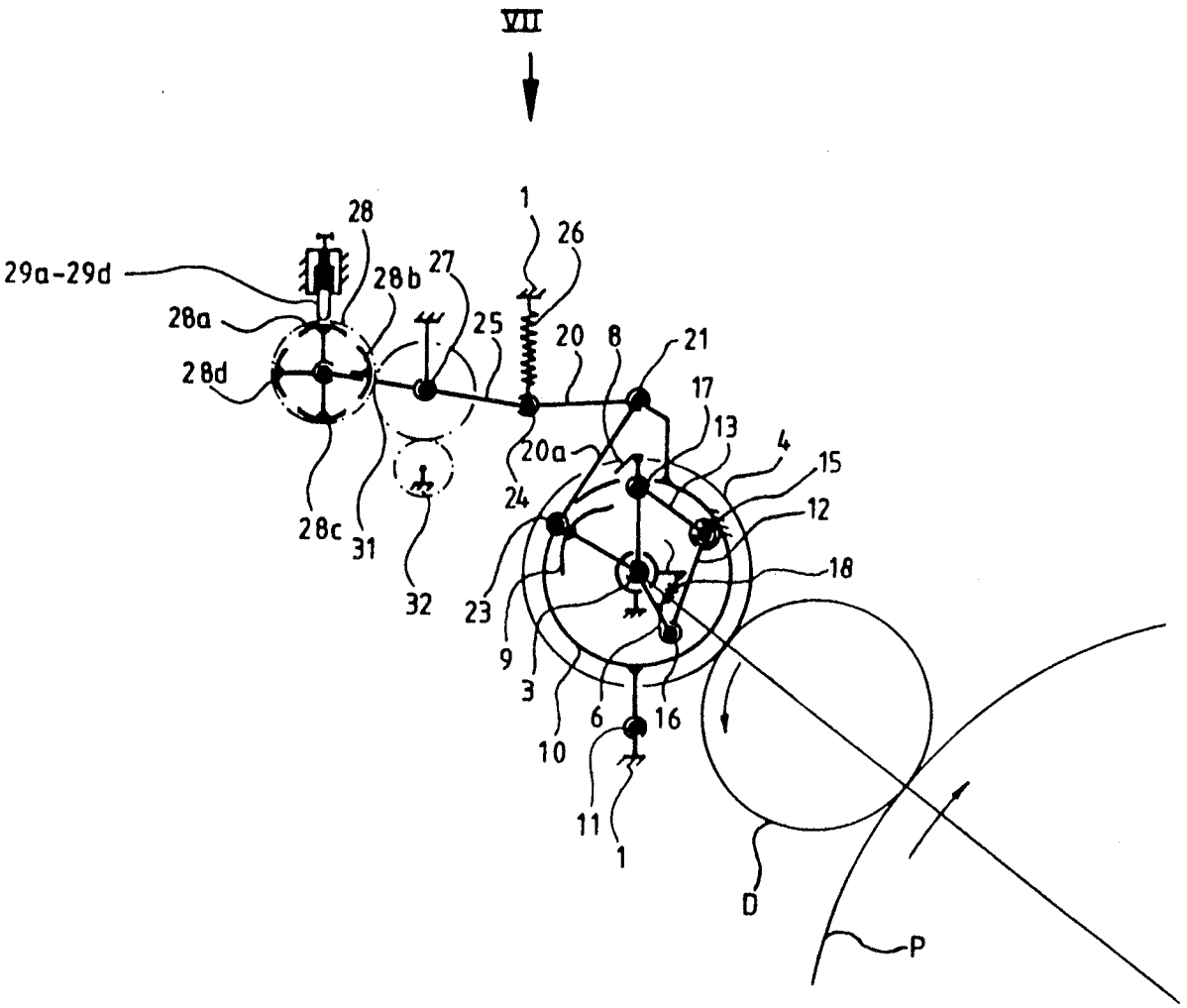
FIG. 6 shows a diagrammatic representation of the principle of the device according to the invention.

According to FIGS. 1 to 5, the transfer cylinder 2 of the device is arranged between a feed roller S and the impression cylinder D of a rotary printing machine, especially an intaglio printing machine, of which the plate cylinder P indicated merely diagrammatically in FIG. 6 interacts with the impression cylinder D and carries at least two printing plates, generally N printing plates, N being greater than 1. In the example described below, the plate cylinder P has four printing plates which are mounted at an angular spacing of approximately 90°, that is to say do not necessarily have to be adjusted on the plate cylinder with a 90° spacing accurate to a fraction of a millimeter.

Figure 1:
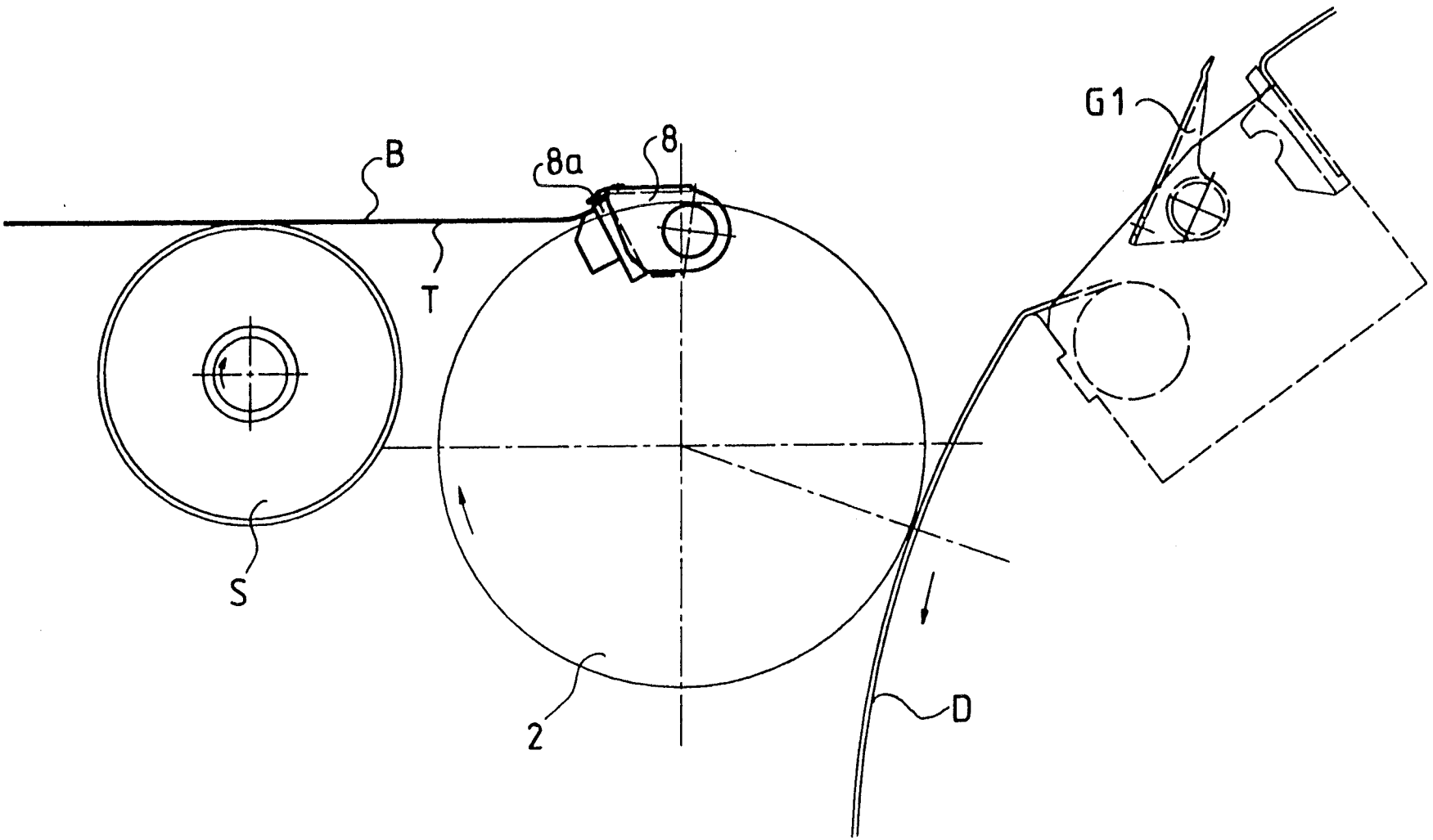
FIGS. 1 and 2 show the arrangement of the transfer cylinder on the printing machine in the sheet-receiving position (FIG. 1 and the sheet-transfer position (FIG. 2), all the details of the transfer cylinder and the setting device being omitted.
Figure 2:
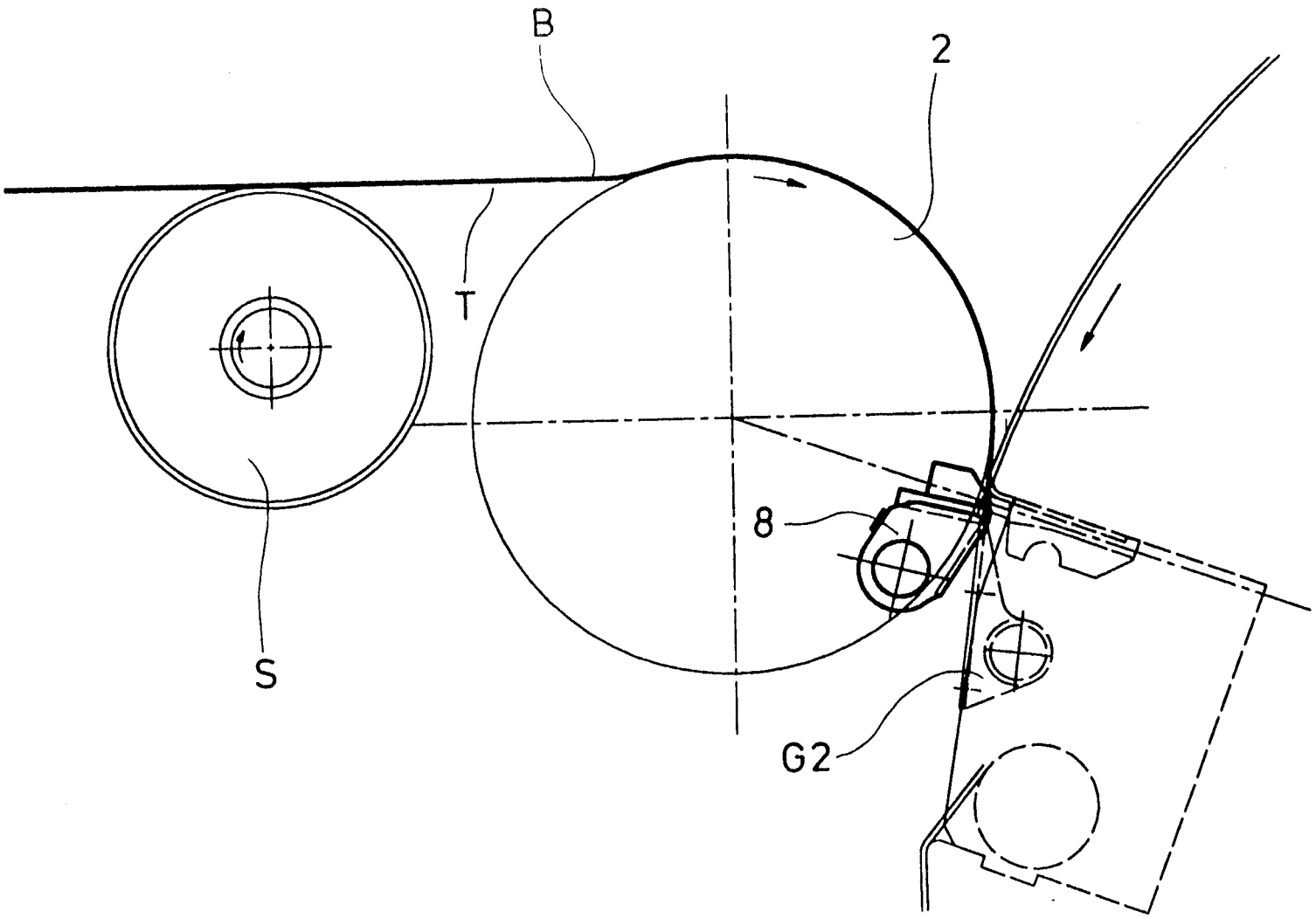

The sheets B are administered to the transfer cylinder 2 individually in succession by the feed roller S which, in the example under consideration, is a known suction roller driven at a non-uniform speed, an oncoming sheet being transported up against the front stop 8a of the transfer cylinder 2 and being taken up by the latter until it is transferred to the impression cylinder D. The front stop 8a is part of a sheet gripper 8 which is articulated on the transfer cylinder 2 and which, according to FIG. 1, is just receiving the sheet B moved on the feed table T indicated diagrammatically and, according to FIG. 2, is transferring it to the sheet gripper G2 of the impression cylinder D. The directions of rotation of all the cylinders are indicated by arrows in FIGS. 1 to 3.

In the example under consideration, according to FIGS. 1 to 5, impression cylinder D and plate cylinder (not shown) are of the same size, and, since there are four printing plates, the impression cylinder D has four printing segments covered with rubber blankets and, in front of each rubber blanket, sheet grippers, of which the gripper G1 can be seen in FIG. 1 and the gripper G2 in FIG. 2. The diameter of the transfer cylinder 2 amounts to 1/N of the diameter of the plate cylinder, that is to say, in the example under consideration, one quarter of this diameter, and correspondingly the transfer cylinder 2 executes, during a complete revolution of the plate cylinder or of the impression cylinder, N revolutions, that is to say, in the example under consideration, four revolutions, and conveys a sheet B each time.

In the region of the suction roller S, there is usually also a known front mark, not shown here, which serves for aligning an oncoming sheet B and which is subsequently pivoted downwards, so that this sheet can be transported onto the transfer cylinder 2. According to FIG. 5, the following sheet B' is already in the aligned position on the suction roller S while the preceding sheet B is still being drawn onto the transfer cylinder 2.

Figure 3:
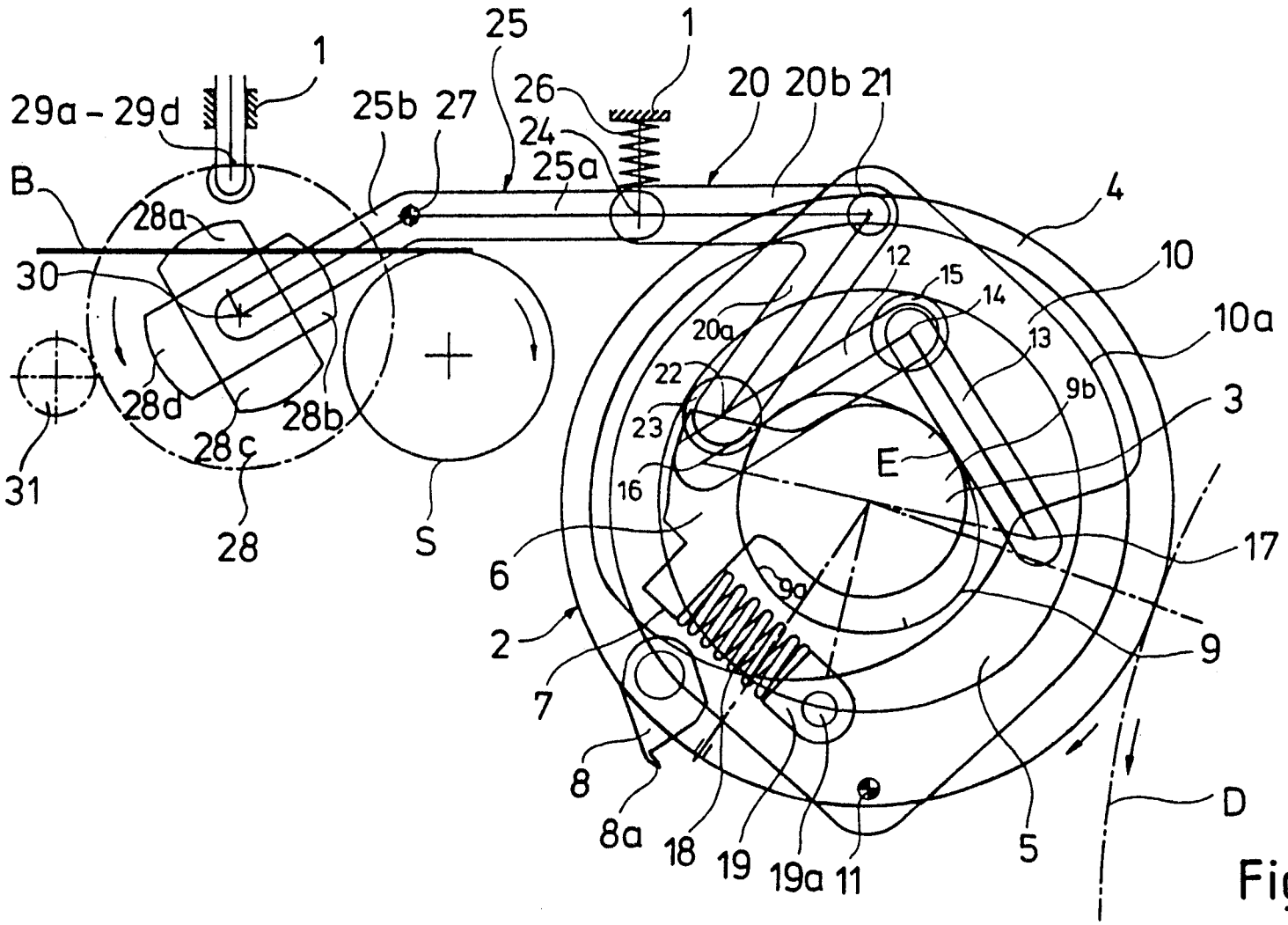
FIGS. 3 to 5 show a similar arrangement of the transfer cylinder with a diagrammatic representation of its construction and of the setting device, specifically in three different working positions, namely before the reception of a sheet (FIG. 3), shortly after the reception of a sheet (FIG. 4) and during the transfer of a sheet to the impression cylinder.

The construction of the device according to the invention is now described with reference to FIGS. 3 to 5 and the highly diagrammatic FIGS. 6 and 7, in which the parts corresponding to the parts shown in FIGS. 3 to 5 are provided with the same reference symbols.

The transfer cylinder 2 has a shaft 3 which is driven at a uniform speed and which executes N revolutions when the plate cylinder P is executing one complete revolution; if the impression cylinder D has the same diameter as the plate cylinder, this generally being the case, then this corresponds, of course, to one revolution of the impression cylinder. In principle, however, the impression cylinder can also have a diameter different from that of the plate cylinder. In the example according to FIG. 6, the diameter of the impression cylinder D amounts to only 1/N of the diameter of the plate cylinder P, that is to say the impression cylinder D is matched only to the size of a sheet and is exactly as large as the transfer cylinder 2.

The transfer cylinder 2 has a drum 4 which is adjustable in the circumferential direction in relation to its shaft 3 and on which the sheet gripper 8 is articulated at its front stop 8a. In actual fact, of course, a plurality of sheet grippers located in a row next to one another is provided both on the transfer cylinder 2 (FIG. 7) and on the impression cylinder D. On one side of the transfer cylinder 2, that is to say axially outside the drum 4 (FIG. 7), the shaft 3 and the drum 4 are connected kinematically to one another by means of two levers 12 and 13. The two levers 12 and 13 are connected pivotably to one another at their one ends at a common articulation point 14. A running roller 15 is mounted rotatably at this articulation point 14. The other end of the lever 12 is articulated by means of a journal 16 on a part 6 fastened to the shaft 3, and the other end of the lever 13 is articulated by means of a journal 17 on a part 5 fastened to the drum 4. In the representation according to FIG. 3, this part 5 is indicated as a thickening of the drum 4. The axis of the shaft 3 and the said levers 12 and 13 are surrounded by an annular setting member 10 which is articulated on the device frame 1 pivotably about a journal 11 located outside the axis of the shaft 3 and which has a cylindrical inner circumference 10a, on which the running roller 15 bears under the effect of a spring 18 and can roll. This spring 18 is compressed between an extension 7 of the part 6 and a spring plate 19 articulated on the part 5 pivotably about the journal 19a and therefore seeks to press shaft 3 and drum 4 in opposite directions, with the result that the articulation point 14 together with the running roller 15 is pressed against the inner circumference 10a of the setting member 10. Moreover, the adjustment of the setting member 10 is assisted by the spring 26.

By means of the control device described below, this setting member 10 can be deflected somewhat in one direction or the other about the journal 11 out of the neutral position, shown in FIG. 3, in which its inner circumference 10a is concentric relative to the axis of the shaft 3, the result of this being, as emerges from the following description, a corresponding displacement of the drum 4 relative to the shaft 3 in one circumferential direction or the other.

This control device has a cam disk 9 fastened laterally to the shaft 3 and in the form of an eccentric, and a lever mechanism which, in the example under consideration, consists of two 2-armed angled levers 20 and 25. The mutually adjacent lever arms 20b and 25a of the two levers are fastened pivotably to one another at a common articulation point 24. The lever 20 is fastened pivotably to the setting member 10 by means of a journal 21 which is located diametrically opposite the journal 11. The other lever arm 20a of the lever 20 extends as far as the circumference of the cam disk 9 and at its end carries a cam roller 23 rotatable about the axis 22. The other lever 25 is articulated on the device frame 1, specifically by means of a journal 27 fastened to this. The end of its other lever arm 25b carries a wheel 28, in the example under consideration a gearwheel which is rotatable about the axis 30 and which is driven at a uniform speed by means of a driving wheel 31, in such a way that, during one complete revolution of the transfer drum, it executes 1/N revolutions, that is to say, in the example under consideration, one quarter of a revolution.

Figure 7:
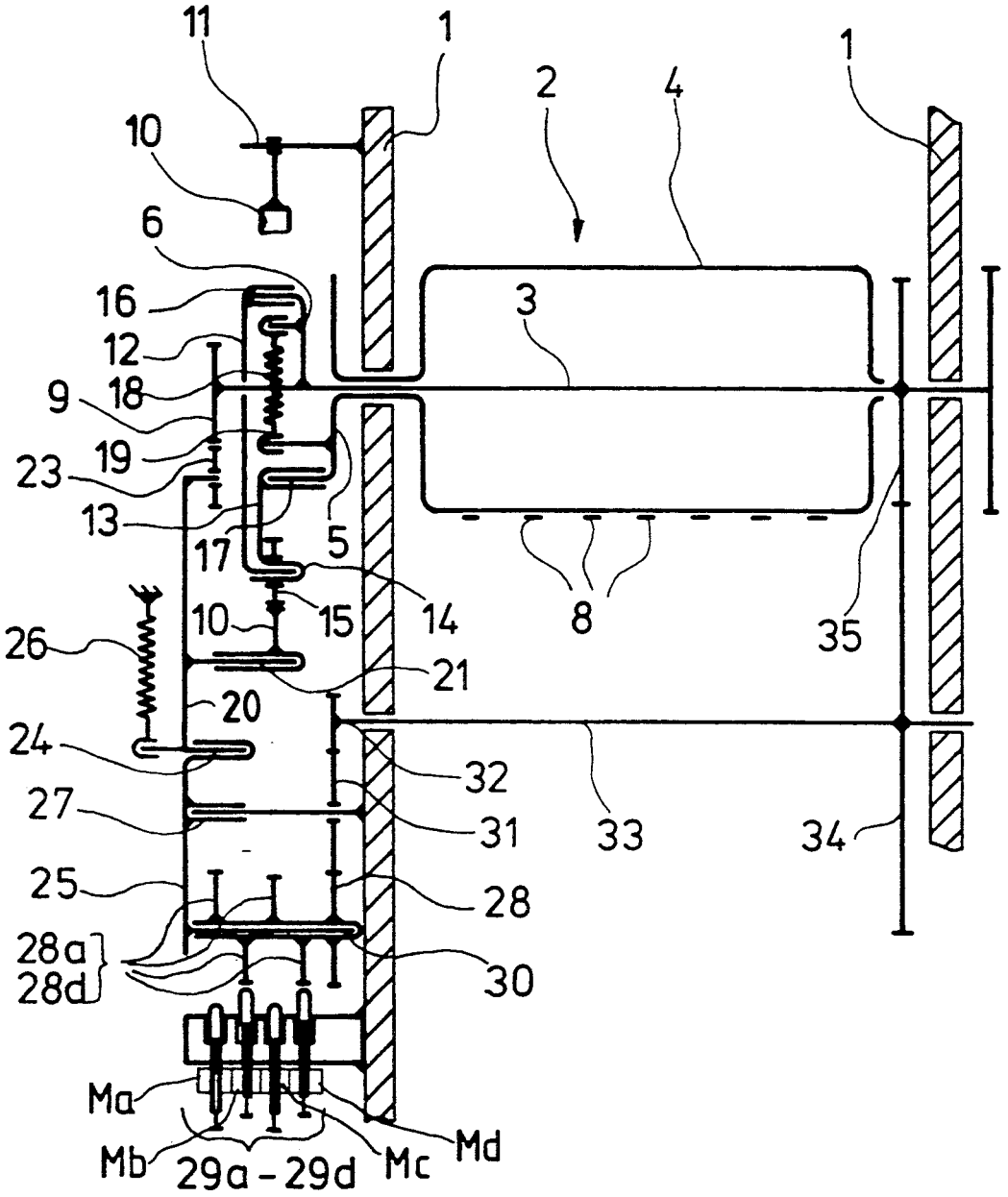
FIG. 7 shows a diagrammatic representation in the direction of the arrow VII according to FIG. 6.

According to FIG. 7, the wheel 28 is driven by means of a gearwheel 35 which is arranged on the shaft 3 and which meshes with a gearwheel 34 of double its size on the axis 33, and via a gearwheel 32 which is arranged on the axis 33 and which meshes with the toothed driving wheel 31 and is half the size of this. The wheel 28, which is the same size as the driving wheel 31, is therefore driven at a reduction ratio of 4:1 in relation to the shaft 3. Fastened axially next to one another on the axis 30 of the wheel 28 are N stop parts 28a to 28d, the mutual angular spacing of which amounts to 360°/N, that is to say 90° in the example under consideration. These stop parts interact with individually adjustable stationary stops 29a to 29d which, located level with the respective stop parts 28a to 28d, are mounted displaceably in the device frame 1 for setting purposes. FIG. 7 shows diagrammatically four different positions of these stops 29*a* to 29*d* and, furthermore, indicates servomotors Ma, Mb, Mc, Md which are coupled to these stops and by means of which the stops can be adjusted.

The above-described lever mechanism consisting of the levers 20 and 25 is therefore pivotable on the frame about the stationary journal 27 and is subjected to a spring 26 which is supported on the frame and which loads the lever mechanism in such a way that the cam roller 23 at the end of the lever 20 is pressed against the cam disk 9. In the example according to FIGS. 3 to 7, the spring 26 acts on the articulation point 24 of the two levers 20 and 25.

When no stops 29*a* to 29*d* are present or active, during the rotation of the shaft 3 the cam roller 23 constantly rolls on the circumference of the cam disk 9 under the effect of the spring 26, with the result that the levers 20 and 25 execute a pivoting movement corresponding to the shape of the eccentric cam disk 9, and consequently, during each revolution of the cam disk, the setting member 10 articulated on the lever 20 pivots to and fro out of its neutral position in exactly the same way. As soon as the inner circumference 10*a* of the setting member 10 is no longer concentric relative to the axis of the shaft 3, the levers 12 and 13 guided along the inner circumference 10*a* by the running roller 15 bring about a slight displacement of the drum 4 relative to the shaft 3 in or oppositely to the direction of rotation of the latter. The amount of pivoting of the setting member 10, that is to say the maximum deflection, is defined by the eccentricity of the cam disk 9. This eccentricity is calculated so that the maximum permissible tolerances in the fastening of the printing plates on the plate cylinder can be compensated by correspondingly corrected sheet transfers to the impression cylinder.

The shape of the cam disk 9 is selected so that approximately one half circumferential portion 9*a* has a shape concentric relative to the axis of the shaft 3, whereas the other half circumferential portion 9*b* has a radius continuously decreasing and then increasing again, that is to say the actual eccentricity. At the same time, the arrangement is such that the cam roller 23 is located in the region of maximum eccentricity, that is to say in the region E of smallest radius of the cam disk 9, when the sheet gripper 8 passes the sheet-transfer position.

However, during each revolution of the transfer drum 2, the maximum possible deflection defined by the eccentricity of the cam disk 9 is so limited by the said adjustable stops 29*a* to 29*d* that, during the sheet transfer, the correction necessary for achieving a perfect register of the sheet in relation to the printing plate printing it is obtained. This therefore ensures that all the printed sheets have a constant margin width between the front edge and print start. This setting of the stops is made either before the beginning of the printing operation on the basis of some test prints by hand or, as indicated in FIG. 7, servomotors Ma, Mb, Mc, Md are provided for this. If the setting does not take place automatically, these servomotors can be actuated from a control desk, for example by pushbutton, or else the servomotors are controlled as a function of register deviations automatically measured by the read- off of register marks. Where unprinted sheets are concerned, this purpose is served, for example by the register marks which are applied during the printing and by the read-off of which the positions of the subsequent sheets are corrected. If the oncoming sheets already have a first print, for example a background, register marks imprinted in the first printing unit can serve for the automatic register correction.

According to FIG. 3, the cam roller 23 bears on the start of the concentric circumferential portion 9*a* of the cam disk 9 under the effect of the spring 26, and according to FIG. 4, while the sheet B is being received by the transfer drum 2, the cam roller 23 is located in the end region of this circumferential portion 9*a*. According to FIG. at the moment when the sheet is transferred to the impression cylinder, the position of the levers 20, 25 and therefore of the cam roller 23 is determined by one of the stops 29*a* to 29*d* , against which the respective stop part 28*a* to 28*d* bears, so that the cam roller 23 remains in a position which is more or less lifted off from the cam disk 9 and which corresponds to the desired displacement of the drum 4 relative to the shaft 3. In this transfer position, the cam roller 23 is located in front of the region E of the smallest radius of the cam disk 9.

FIG. 5 shows three different positions S1, S2 and S3 of the adjustable parts, specifically a middle position and two extreme positions, that is to say a position displaced to one side and a position displaced to the other side. In the position S1 represented by unbroken lines and determined by the stop 29*a*, the drum 4 assumes relative to the shaft 3 a middle position which can correspond, for example, to the exactly adjusted position of the respective printing plate on the plate cylinder. In the position S2 represented by dot-and-dash lines, the active stop 29*b* is further away from the axis 30 of the wheel 28, so that the lever 25 is pivoted somewhat in the clockwise direction in relation to the position S1. This causes the transfer point of the transfer cylinder 2 to be displaced somewhat oppositely to its direction of rotation. In the position 3 represented by a broken line with a dash and two respective dots, the active stop 29*b* is displaced somewhat in the direction of the axis 30 relative to the position S1, so that in this case the transfer point of the transfer cylinder 2 is displaced somewhat in the direction of rotation of the latter. In general, it is sufficient to provide a maximum displacement of the drum 4 relative to the shaft 3 of ± one millimeter, because the adjustment of the printing plates on the plate cylinder with a maximum tolerance of one millimeter is possible without difficulty and without taking up a large amount of time.

The device according to the invention is not restricted to the exemplary embodiment described, but permits of many different forms of construction.

I claim:

1. Device for transferring individual sheets to the impression cylinder of a sheet-fed rotary printing machine which has a plate cylinder equipped with N printing plates, N being a whole number greater than with a transfer cylinder interacting with the impression cylinder, characterized in that the transfer cylinder (2) has a front stop (8*a*) adjustable in the circumferential direction relative to its shaft (3) for the oncoming sheets (B) and is of a diameter equal to 1/N of the diameter of the plate cylinder (P), in that the shaft (3) of the transfer cylinder (2) is drivable at a constant speed and executes N revolutions when the plate cylinder (P) executes one revolution, and in that there is a controllable setting device which, during each revolution of the transfer cylinder (2), so displaces the front stop (8*a*) relative to the shaft (3) that this front stop (8*a*), when its transfer position in which a sheet is transferred to the impression cylinder is passed, assumes a position by which the exact register of this sheet in relation to the position of the printing plate printing it on the plate cylinder (P), is set.

2. Device according to claim 1, characterized in that the transfer cylinder (2) has a drum (4) adjustable in the circumferential direction relative to its shaft (3), and the said front stop (8*a*) is part of a sheet gripper (8) articulated on this drum (4).

3. Device according to claim 2, characterized in that the shaft (3) and the drum (4) of the transfer cylinder (2) are connected by means of two levers (12, 13) which are fastened to one another in an articulated manner at their one ends and of which one lever (12) is articulated at the other end on a part (6) fastened to the shaft (5) and the other lever is articulated at the other end on a part (5) fastened to the drum (4), and which carry a running roller (15) at their common articulation point (14), in that there is an annular setting member (10) which surrounds the axis of the shaft (3) and which is articulated on the frame (1) of the device pivotably about a journal (11) located outside the axis of the shaft (3) and has a cylindrical inner circumference (10*a*), on which the said running roller (15) bears under the effect of a spring (18) and can roll, and in that there is a control device which causes the setting member (10) to pivot during each revolution of the transfer drum (2) and which deflects this setting member (10) out of a neutral position into a position eccentric relative to the axis of the shaft (3), in such a way that the two levers (12, 13) guided by the said running roller (15) adjust the drum (4) relative to the shaft (3) in the desired way.

4. Device according to claim 3, characterized in that the said spring (18) is arranged between a part fastened to the shaft (3) and a part fastened to the drum (4) and presses shaft (3) and drum (4) in opposite directions.

5. Device according to claim 4, characterized in that the running roller (15), the levers (12, 13) and the said parts (5, 6) are so arranged in the circumferential direction that the setting member (10) is pressed into the respective working position by means of the pressure force.

6. Device according to claim 3, characterized in that the control device has a cam disk (9) fastened to the shaft (3) and in the form of an eccentric, and a lever mechanism which, on the one hand, is articulated on the side of the setting member (10) located opposite the journal (11) and, on the other hand, is mounted pivotably on a rotary axle (27) attached firmly to the device frame (1), in that this lever mechanism carries, at one end, a cam roller (23) which seeks to press a spring (26) against the circumference of the cam disk (9), with the result that, during the rotation of the shaft (3), the lever mechanism and consequently the setting member (7) is adjustable according to the shape of the cam disk (9), and in that the maximum possible adjustment of the lever mechanism defined by the eccentricity of the cam disk (9) can be limited by N individually adjustable stops (29*a* to 29*b*) which are activated in succession during N respective successive revolutions of the transfer cylinder (2).

7. Device according to claim 6, characterized in that the lever mechanism consists of two levers (20, 25) which are connected to one another in an articulated manner at their one ends and of which one lever (20) is articulated on the setting member (10) and at its other end carries the said cam roller (23), whilst the other lever (25) is articulated on the device frame (1) and at its other end carries a rotatable drivable wheel (28), to which are fastened N stop parts (28*a* to 28*d*) which each interact with one of the N adjustable stops (29*a* to 29*d*), the stop parts being arranged next to one another in the axial direction of the wheel (28) and at an angular spacing of 360°/N, and the stops (29*a* to 29*d*) being installed in a row next to one another, and the wheel (28) executing 1/N revolutions during a complete revolution of the transfer cylinder (2).

8. Device according to claim 7, characterized in that the adjustable stops (29*a* to 29*d*) are coupled to servomotors (Ma, Mb, Mc, Md) which can be switched on by hand or which are controllable as a function of the register deviations automatically measured by the reading of register marks.

* * * * *